United States Patent [19]

Glendening

[11] 4,373,985

[45] Feb. 15, 1983

[54] ADHESIVE BINDER

[75] Inventor: Major D. Glendening, St. Joseph, Mich.

[73] Assignee: F. P. Rosback Company, St. Joseph, Mich.

[21] Appl. No.: 250,046

[22] Filed: Apr. 1, 1981

[51] Int. Cl.[3] ..... B42C 19/00

[52] U.S. Cl. ..... 118/103; 51/273; 118/100; 118/223; 118/218; 118/271; 156/486; 156/489; 156/490; 156/491; 156/578; 156/908; 412/29; 412/37

[58] Field of Search ..... 156/477 B, 489–491; 51/273; 144/252 R; 83/925 A, 100–101; 74/99 R, 103, 104, 40, 45; 11/1 AD, 1 ET; 118/223, 236, 238, 100–101, 271, 258; 427/356

[56] References Cited

U.S. PATENT DOCUMENTS

| | | | |
|---|---|---|---|
| 1,453,020 | 4/1923 | Muslar | 156/491 |
| 2,645,886 | 7/1953 | Peterson | 51/273 X |
| 2,919,590 | 1/1960 | Griswold | 74/104 |
| 3,135,151 | 6/1964 | Link et al. | 83/100 X |
| 3,731,330 | 5/1973 | French | 11/1 AD |

*Primary Examiner*—David A. Simmons

*Attorney, Agent, or Firm*—Oltsch, Knoblock & Hall

[57] ABSTRACT

An adhesive binding machine which is for gluing the covers to the collated pages of the books and which includes a cutter for trimming the edges of the pages, a glue pot for applying glue to the cut edges, a nipper for pressing a cover to the glued edges of the pages and pinching it around the pages.

8 Claims, 17 Drawing Figures

ADHESIVE BINDER

SUMMARY OF THE INVENTION

This invention relates to a binding machine for adhesively attaching covers to the collated pages of a book or similar leafed material.

The binding machine is of the type commonly used to attach a cover to the pages of a book or pamphlet where the pages are carried along the length of the machine and are treated in preparation for application of the cover during their travel. The collated pages are firmly held by a carrier which is driven along the length of the machine, passing the pages over several operative stations. The machine includes a cutting station, a gluing station, a nipper station, and a delivery station.

The cutting station of this invention has an improved design for cutting the page edges to be bound and removing dust and debris therefrom. The gluing station makes use of two parallel rollers and an improved internal design of the glue pot to apply glue to the cut edges of the pages. A set of strings stretched across the glue pot removes excess glue such as glue stringers from the pages after they pass over the rollers. The nipper station applies the cover to the glued edge of the pages by rising up to press the cover against the glued edge and in the same motion pinches the cover against the sides of the pages. The carrier momentarily ceases its motion while the cover is applied and then proceeds to the delivery station, releases the book, and returns to its original position to receive another set of collated pages. The stations have been designed to improve the operability and efficiency of the binding machine.

Accordingly, it is an object of this invention to provide an improved adhesive binding machine.

Another object of this invention is to provide an improved cutting station in an adhesive binder for trimming the edges of the pages to be bound.

Another object of this invention is to provide an improved means for placing glue on the trimmed edges of collated pages in a binding machine.

Still another object of this invention is to provide an improved nipper for applying a cover or binding to the glued edges of collated pages.

Other objects of this invention will become apparent upon a reading of the following description.

DESCRIPTION OF THE PREFERRED EMBODIMENT

Figure 1:
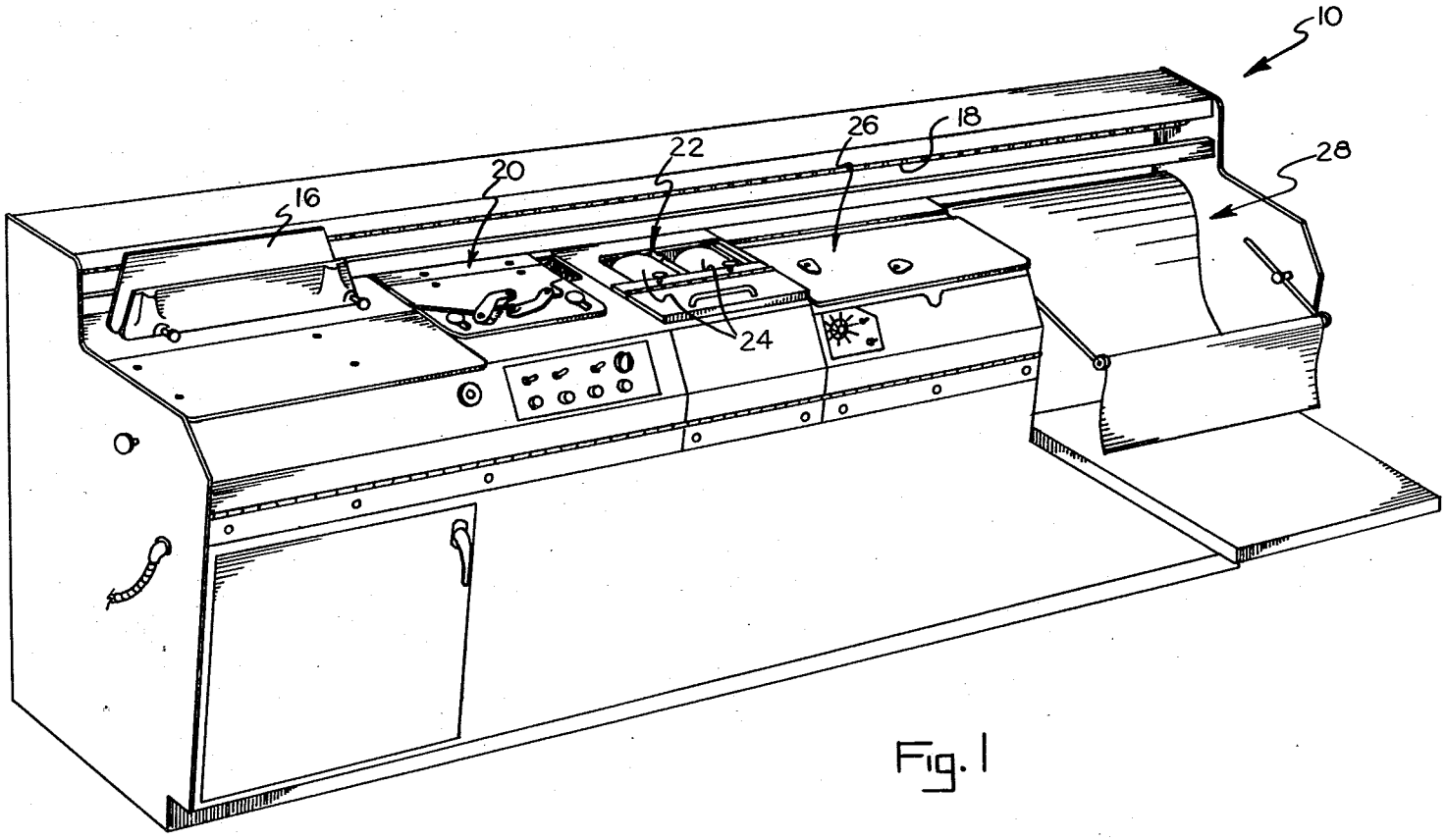
FIG. 1 is a perspective view of the binding machine of this invention.
Figure 2:
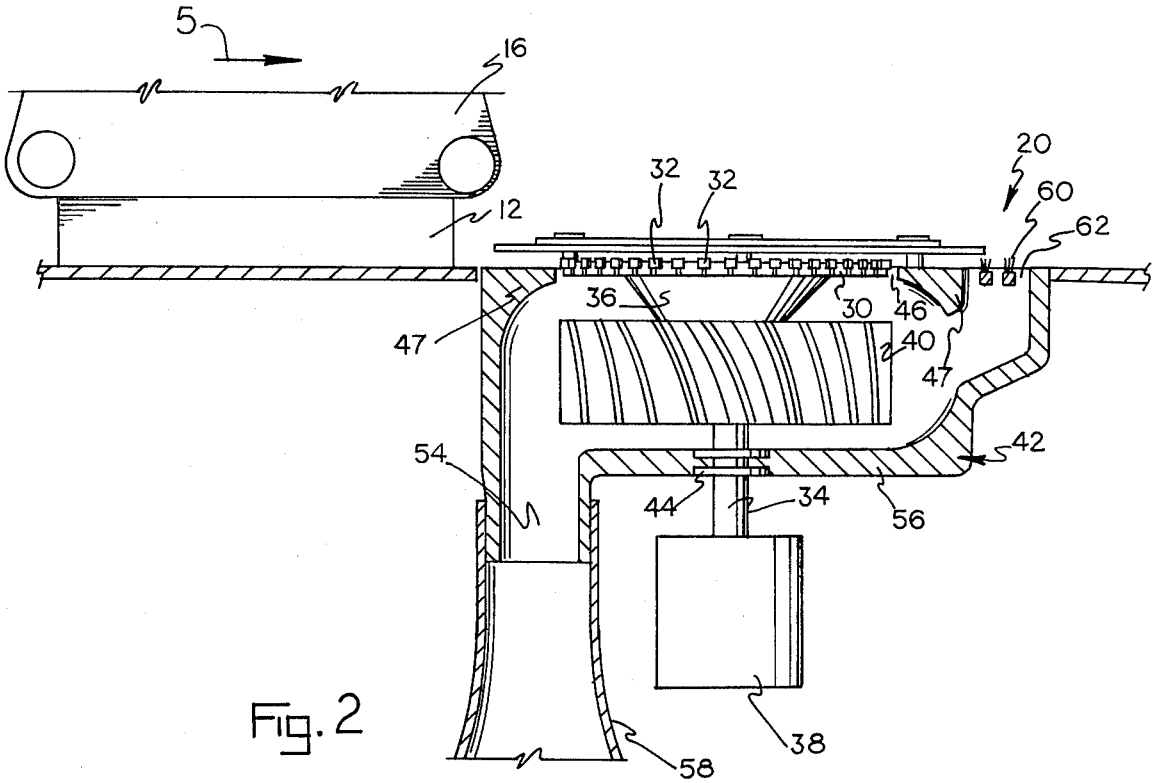
FIG. 2 is a vertical sectional view of the cutting station showing the collated pages prior to crossing the cutter.

The preferred embodiment illustrated is not intended to be exhaustive or to limit the invention to the precise form disclosed. It is chosen and described in order to explain the principles of the invention and its application and practical use to thereby enable others skilled in the art to utilize the invention.

The binding machine 10 of this application is used to bind a series of collated pages 12 by adhesively attaching a cover 14 to the pages. Pages 12 are carried along the length of binder 10 by a carrier 16 which is driven by a chain 18 and associated motor drive (not shown). Carrier 16 grips pages 12 securely once they are inserted as a group and the carrier has begun its route along the binder.

Binder 10 includes four stations at which pages 12 are treated in preparation for application of cover 14 and the cover itself actually applied. The first station is a cutting station 20 where the edges of collated pages 12 to be bound are trimmed and roughed in preparation for the application of glue. The second station includes a glue pot 22 having rollers 24 which are adjustable in height to contact the trimmed edges of pages 12 and apply glue thereto. The third station is the nipper 26 which applies cover 14 to pages 12. Carrier 16 is electrically braked to momentarily pause over nipper 26 while cover 14 is being applied. Following application of cover 14, carrier 16 proceeds along its track to the delivery slide 28 where it releases the bound and covered pages. When pages 12 are released, carrier 16 returns to its starting position to receive another group of pages for binding and the cycle is repeated. The individual stations where novel improvements have been incorporated will now be more fully explained and described.

THE CUTTING STATION

Figure 3:
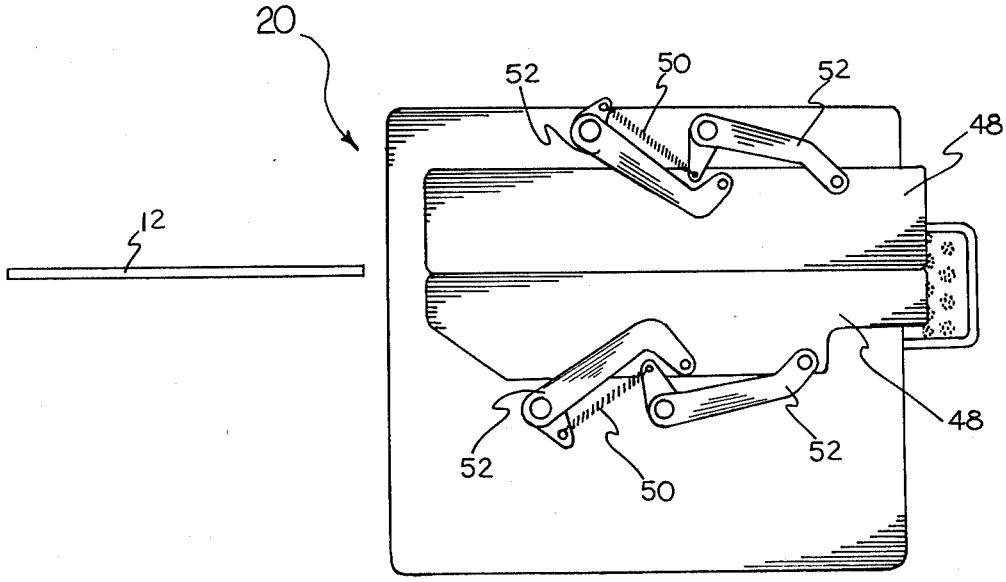
FIG. 3 is a top plan view of the cutting station of this invention.
Figure 4:
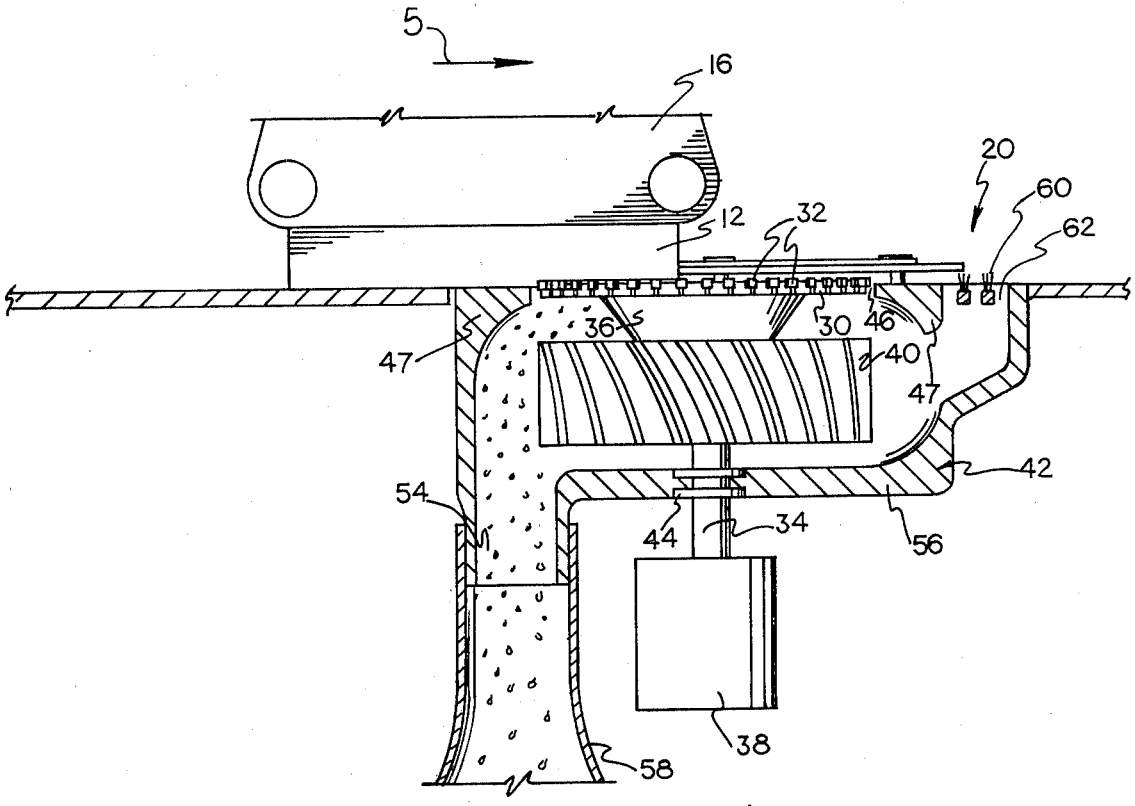
FIG. 4 is a vertical sectional view of the cutting station showing the collated pages while they cross the cutter.
Figure 5:
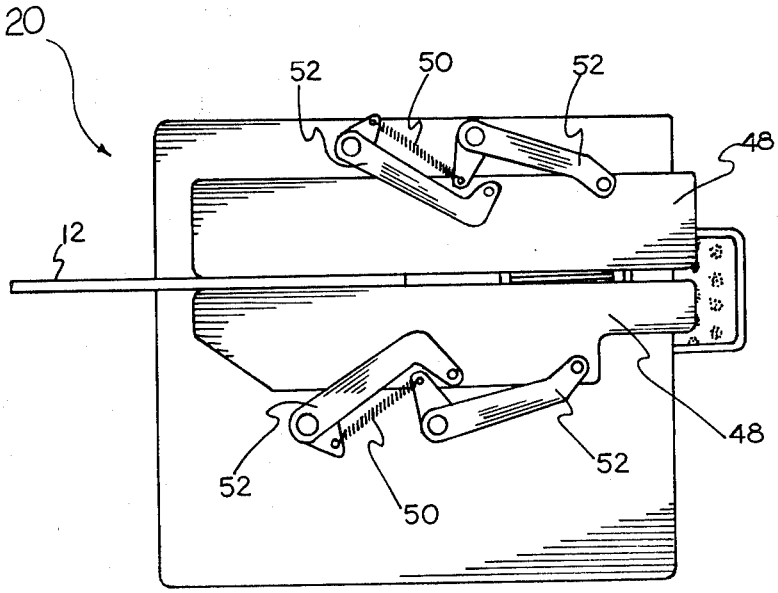
FIG. 5 is a top plan view of the cutting station of this invention showing the collated pages crossing the cutter.
Figure 6:
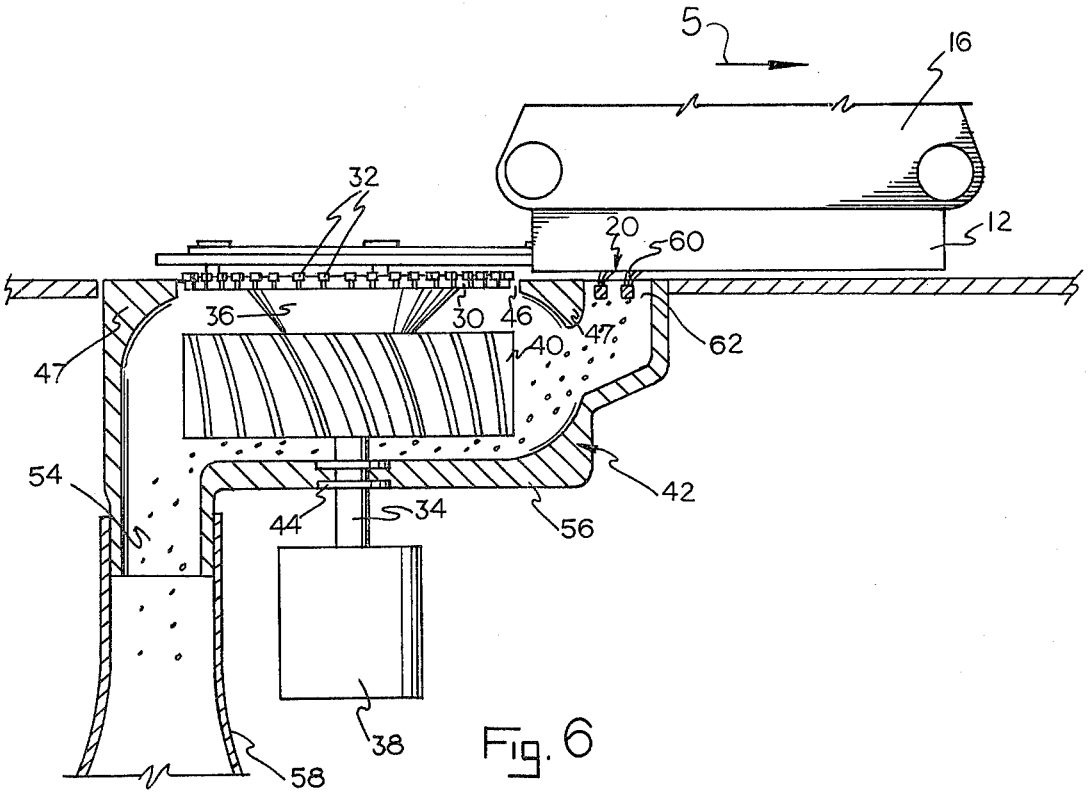
FIG. 6 is a vertical sectional view of the cutting station showing the collated pages after they have crossed the cutter.
Figure 7:
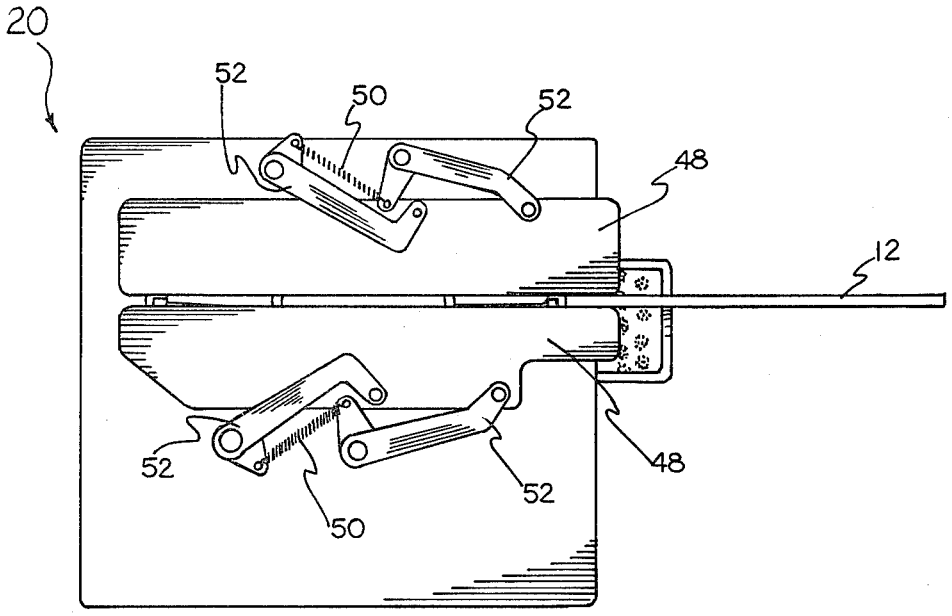
FIG. 7 is a top plan view of the cutting station showing the collated pages after they have crossed the cutter.

Cutter 20 includes a cutting blade 30 having teeth 32. Cutting blade 30 rotates on a shaft 34 and is carried thereon by an arbor 36. Shaft 34 is connected to an electric motor 38 and mounts an impeller 40 between the motor and arbor 36. A housing 42 encloses cutting blade 30, arbor 36, and impeller 40 with shaft 34 being journalled in housing bearings 44 to connect to motor 38 outside of the housing. Housing 42 has an opening 46 in its upper wall 47 through which cutting blade 30 extends to trim the lower edges of pages 12 as the pages pass over housing 42 flush with its upper wall. Hinged guard plates 48 cover cutting blade 30 and are normally closed as illustrated in FIG. 3 to prevent injury to the operator of the machine. Guard plates 48 are spring loaded, as at 50, to remain in the closed position. The hinges which carry plates 48 are a set of parallel arms 52 so that the guard plates move apart in a continuous parallel relationship. Housinng 42 has a second opening 54 in its lower wall 56 which preferably communicates with a bag 58. As pages 12 are propelled over cutting blade 30, as illustrated sequentially in FIGS. 2–7 in the direction of arrow 5, guard plates 48 are forced apart but remain in contact with the sides of the pages. The particles of dust and debris created by the trimming action are drawn into housing 42 by impeller 40 and forced out through opening 54 to be collated in bag 58. When pages 12 have completed passage over cutting blade 30 they contact several brushes 60 located in an opening 62 which communicates with the interior of housing 42. Brushes 60 remove any remaining particles from the trimmed edges of pages 12 and impeller 40 draws them through opening 62, into housing 42, and out through opening 54 into bag 58. The edges of pages 12 are thus evenly trimmed and cleaned in preparation for gluing and binding.

THE GLUE STATION

Referring to FIGS. 8–13, glue pot 22 includes side walls 64 and two parallel rollers 66, 67. Roller 66 is upstream and roller 67 is downstream in relation to the direction of travel of pages 12. Glue pot 22 contains a quantity of glue 68 through which rollers 66, 67 rotate to coat their surfaces and carry the glue to the edges of pages 12. Glue 68 is melted into liquid form by heating element 69 attached to the floor 82 of glue pot 22. The height of glue pot 22 is vertically adjustable to apply a heavier coat of glue in its higher position and a lighter coat in its lower position. Adjustability is accomplished with dual eccentric shafts 71 connected by a chain 73 so that rotation of handle 75 in the direction indicated by arrows 65 raises and lowers the platform 77, as indicated by arrows 79, upon which glue pot 22 rests. The speed of rotation of rollers 66, 67 is also adjustable so that their peripheral speed is approximately the same as the linear speed of pages 12. Rollers 66, 67 are each driven by a spur gear 70 which in turn is driven by a drive gear 72 connected by a shaft 74 to an electric motor or some other power supply. The drive gears are on the outside of the glue pot 22 and the axles of rollers 66, 67 extend through and are journalled at one end in a side wall 64. The other ends of the roller axles are journaled in a divider wall 76. Divider wall 76 depends from a cross bar 78 which rests at each end in notches 80 in opposing side walls 64. The bottom edge of divider wall 76 is spaced from the floor 82 of glue pot 22 to allow glue to flow underneath it to rollers 66, 67. A second divider wall 84 is attached to the upper edge of opposing walls 64 and spans glue pot 22 parallel to divider wall 76. Divider wall 84 is of the open mesh type and extends to floor 82 of the glue pot. Solid glue may be added to glue pot 22 between divider wall 84 and side wall 64. The solid glue will then melt and join the regular flow of hot glue through the open mesh of the divider wall. Application of lumpy glue to pages 12 is thus prevented.

Figure 8:
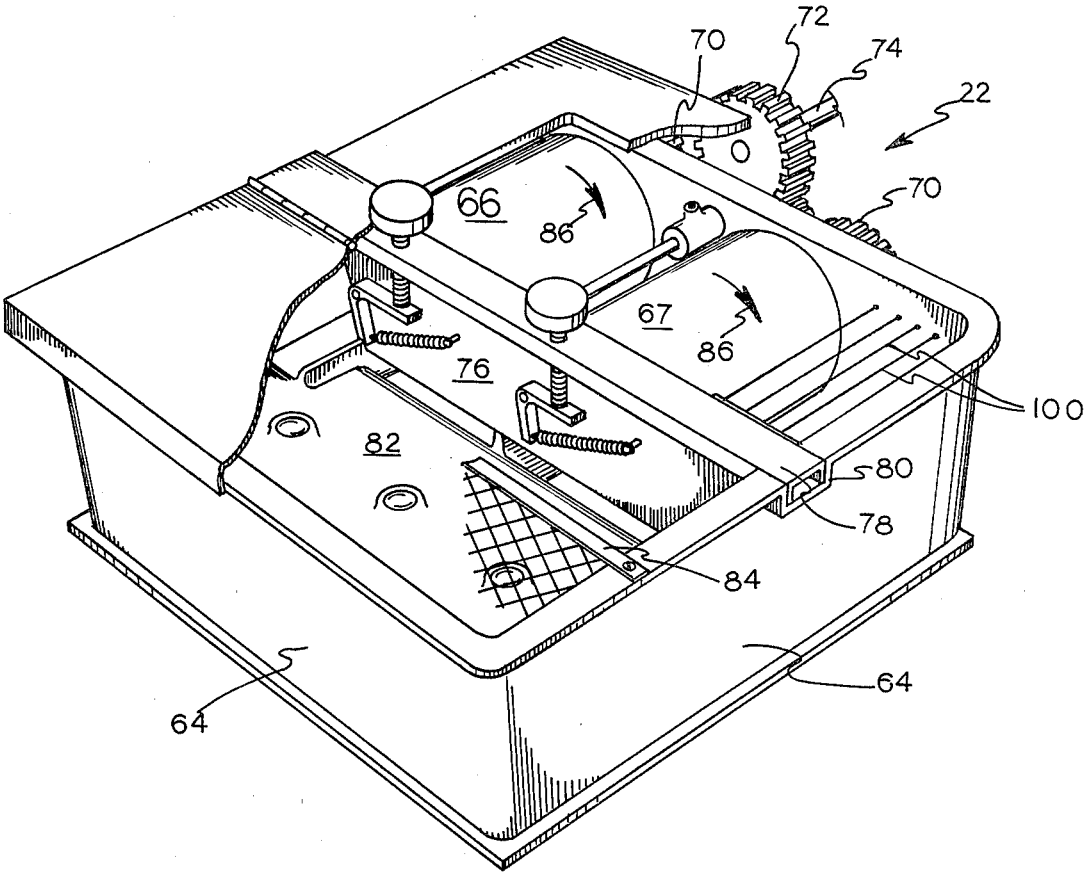
FIG. 8 is a perspective view of the glue pot of this invention with portions cut away from illustration.
Figure 9:
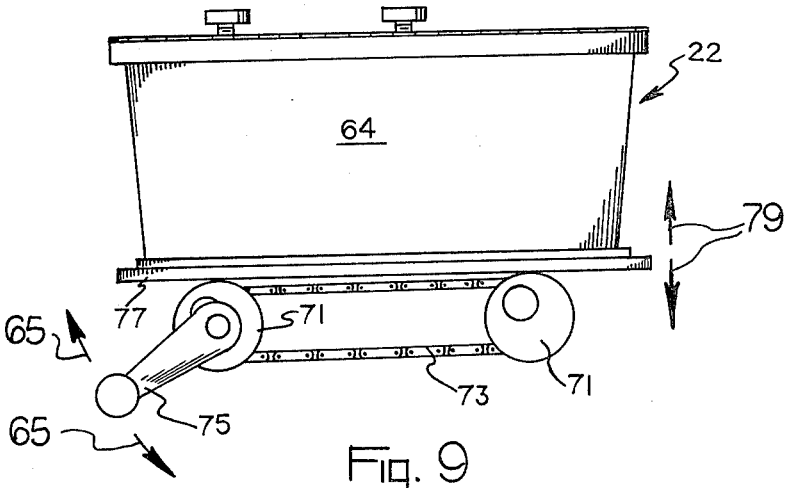
FIG. 9 is an end elevational view of the glue pot.
Figure 10:
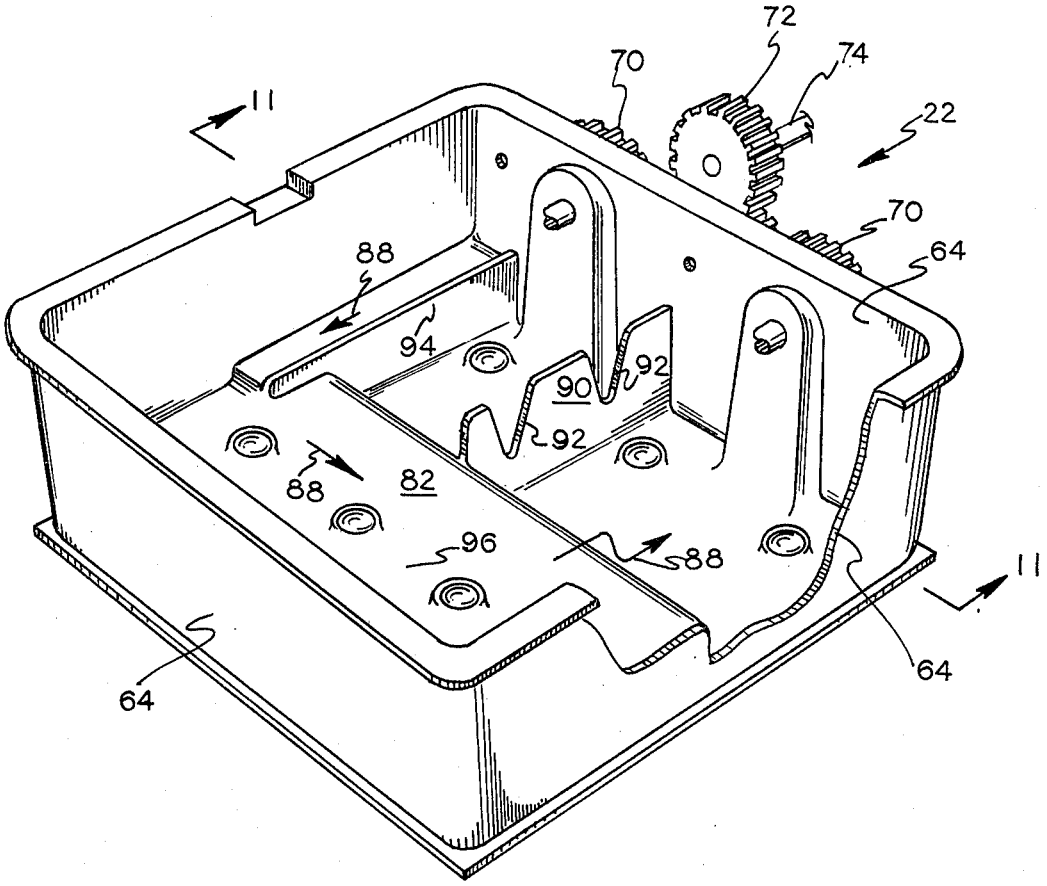
FIG. 10 is a perspective view of the glue pot with portions cut away for illustration.
Figure 11:
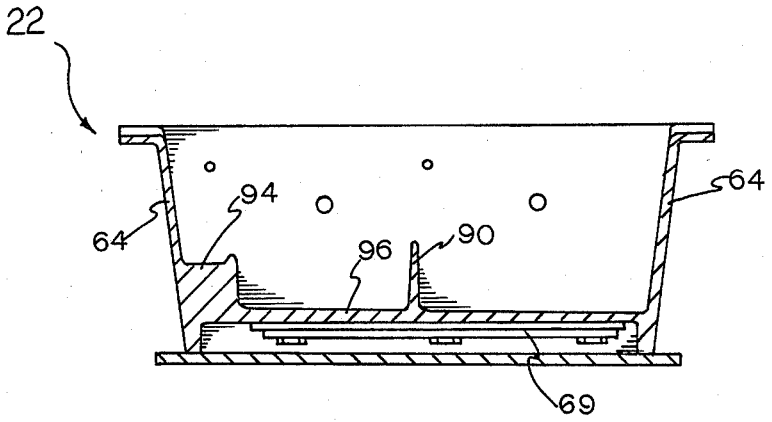
FIG. 11 is a sectional view taken along line 11—11 of FIG. 10.

Rollers 66, 67 rotate in the same direction as indicated by arrows 86 in FIG. 8, thereby creating a direction of glue flow as indicated by arrows 88 in FIG. 10. Floor 82 of glue pot 22 is constructed to facilitate an even flow of glue throughout glue pot 22 and an even application of glue to pages 12 as they pass over rollers 66, 67. A notched wall 90 stands between rollers 66, 67 and is approximatey one half of the height of the rollers. Wall 90 forms a separate compartment for each roller 66 and 67 and dams the glue so that rotation of the rollers does not cause the glue to flow entirely to roller 66 and leave roller 67 dry. Notches 92 allow some glue to flow between the compartments so that the compartments are equally filled with glue. A shoulder 94 is formed against side wall 64 adjacent roller 66 and slopes downwardly in the direction of arrow 88 of FIG. 10. A raised floor section 96 slopes downwardly toward the downstream side of glue pot 22 to move glue to downstream roller 67.

Figure 12:
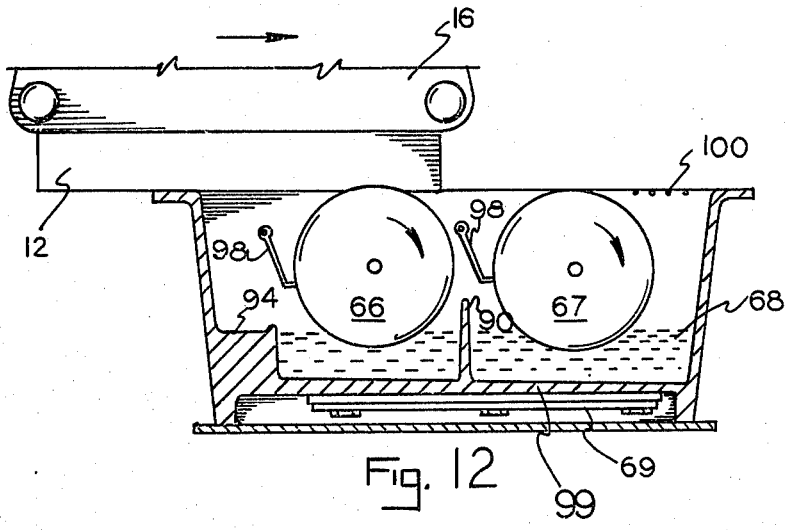
FIG. 12 is an elevational view of the glue pot showing the collated pages passing over the first roller.
Figure 13:
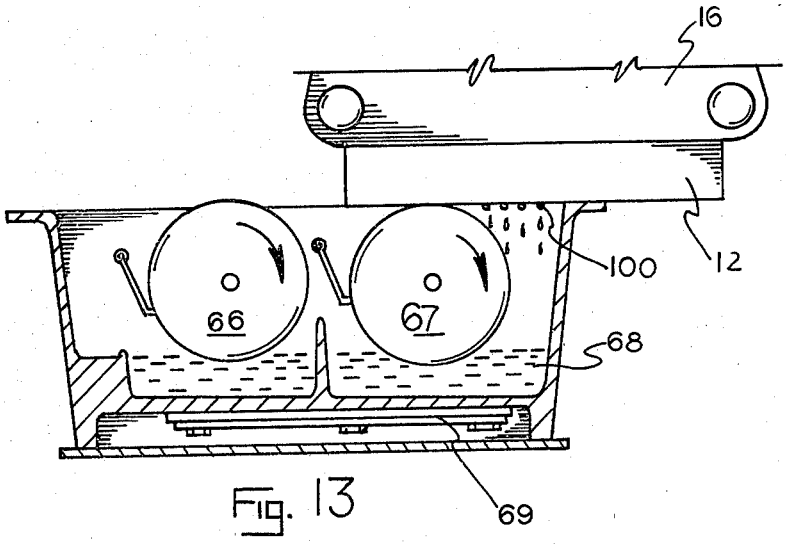
FIG. 13 is an elevational view of the glue pot showing the collated pages passing over the second roller.

Upstream roller 66 is slightly higher than downstream roller 67 so that when pages 12 pass over them, as illustrated in FIGS. 12 and 13, roller 66 mashes glue 68 between the pages and roller 67 applies a second coat only on the edge of the pages. An adjustable scraper 98 is located on the upstream side of each roller to control the amount of glue 68 that each roller carries up to apply to pages 12. Several strings 100, preferably formed of wire, are located downstream from roller 67 and are strung across the top edge of glue pot 22 to scrape excess glue such as glue stringers from the edge after the pages pass over downstream roller 67.

THE NIPPER STATION

Figure 14:
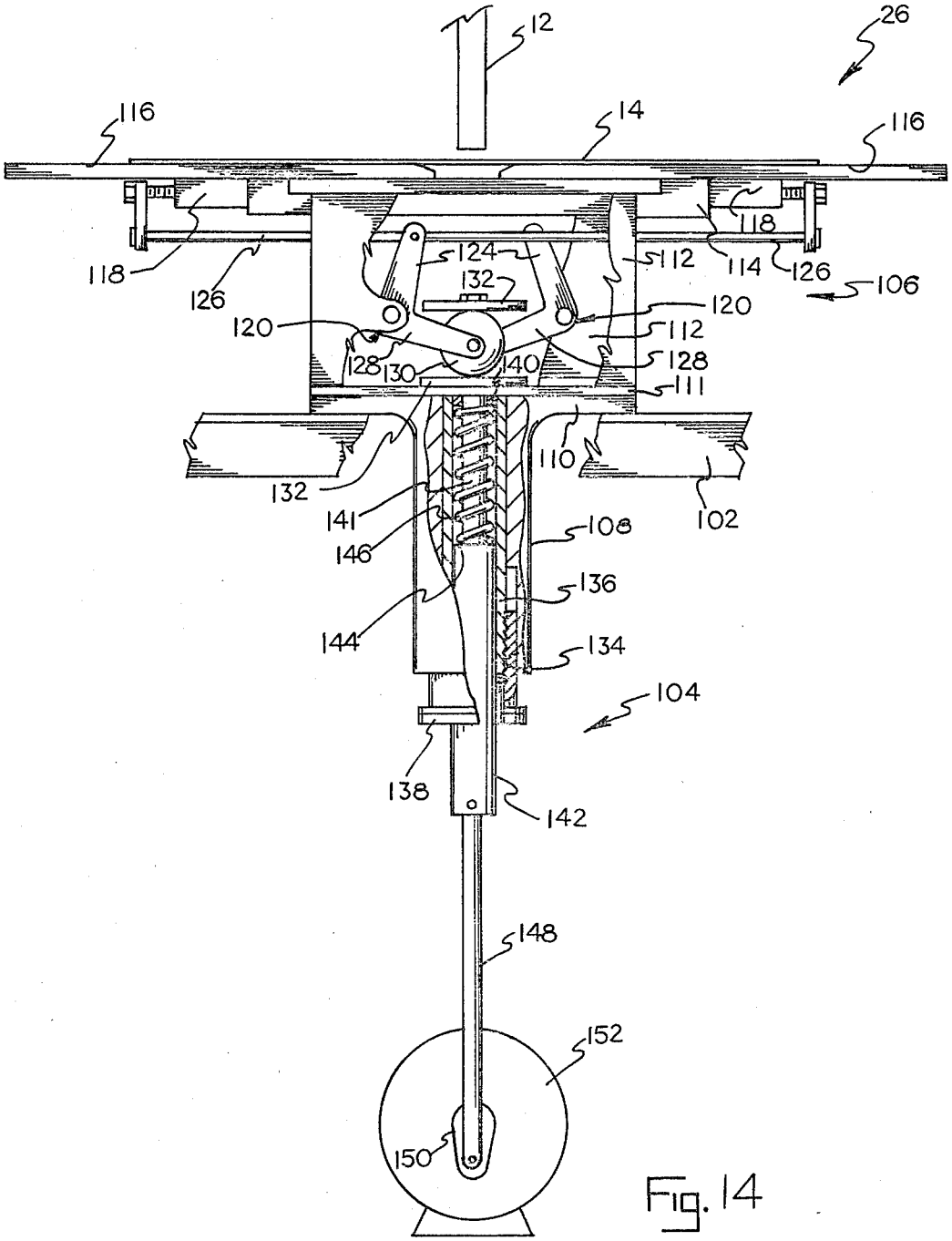
FIG. 14 is a side elevational view of the nipper of this invention with portions cut away for illustration and shown prior to application of the cover to the pages.
Figure 15:
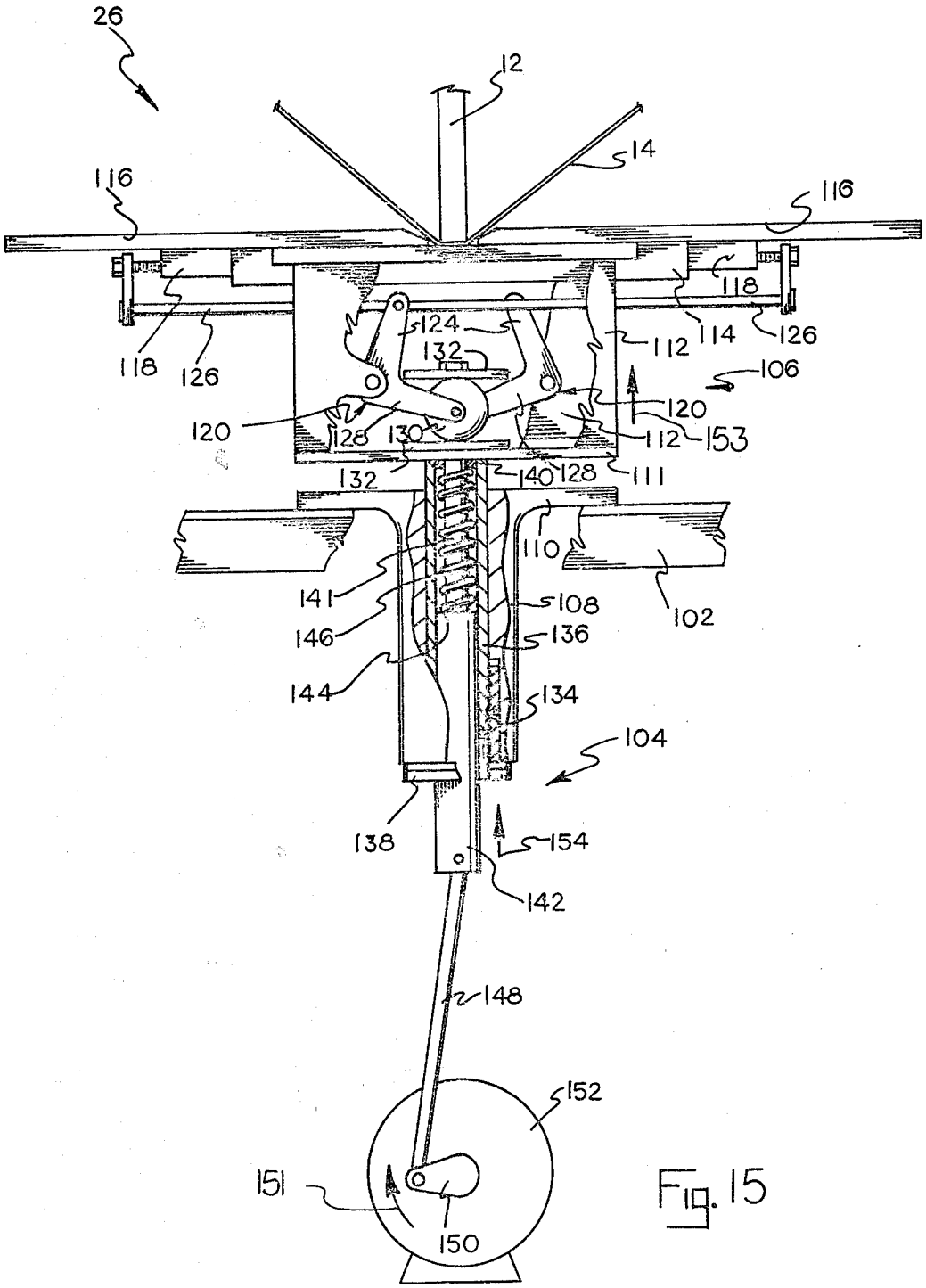
FIG. 15 is a side elevational view of the nipper partially through its cycle with the cover being initially applied to the pages.
Figure 16:
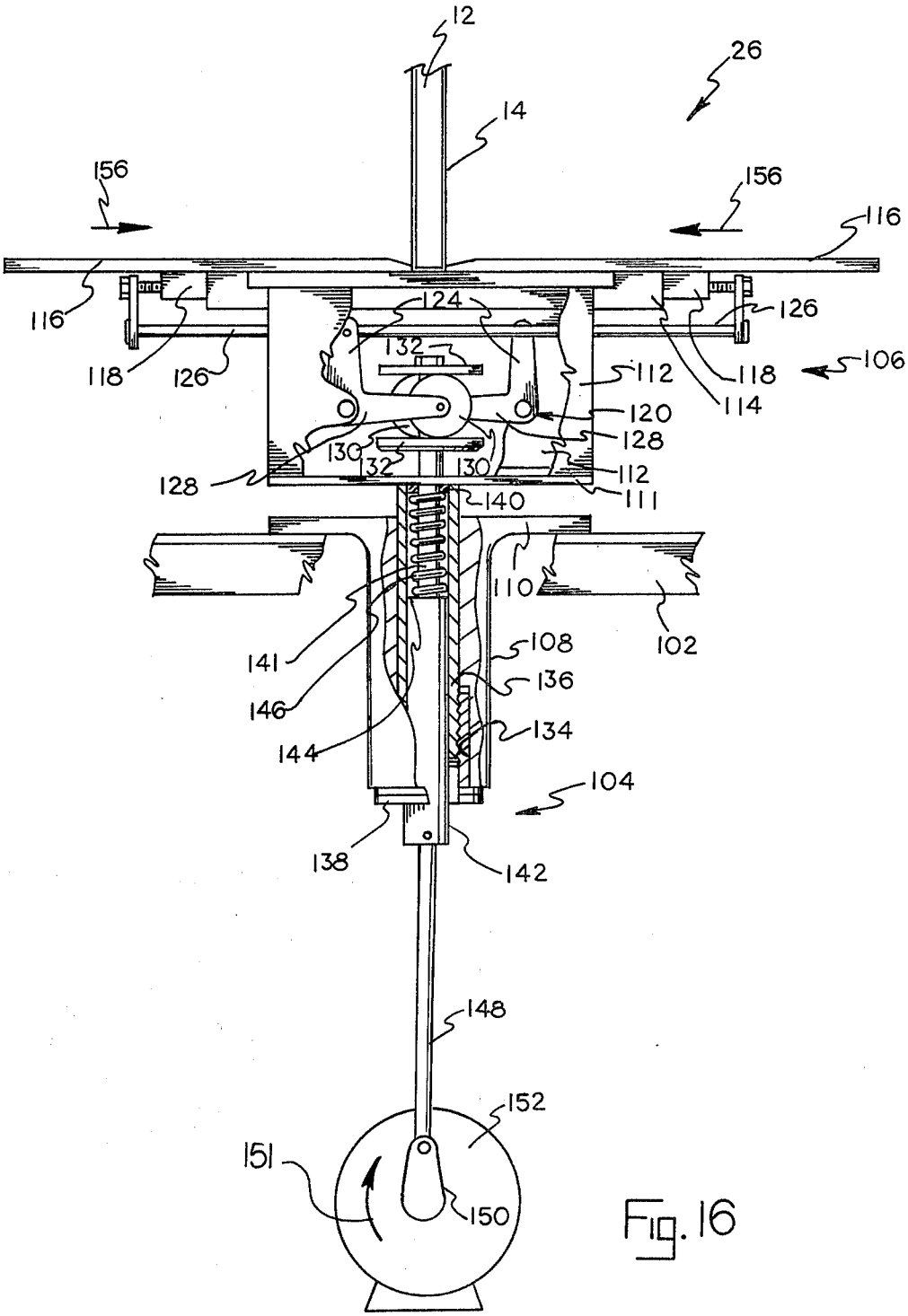
FIG. 16 is a side elevational view of the nipper at the peak of its cycle prior to returning to the start of the cycle with the cover applied about the pages.
Figure 17:
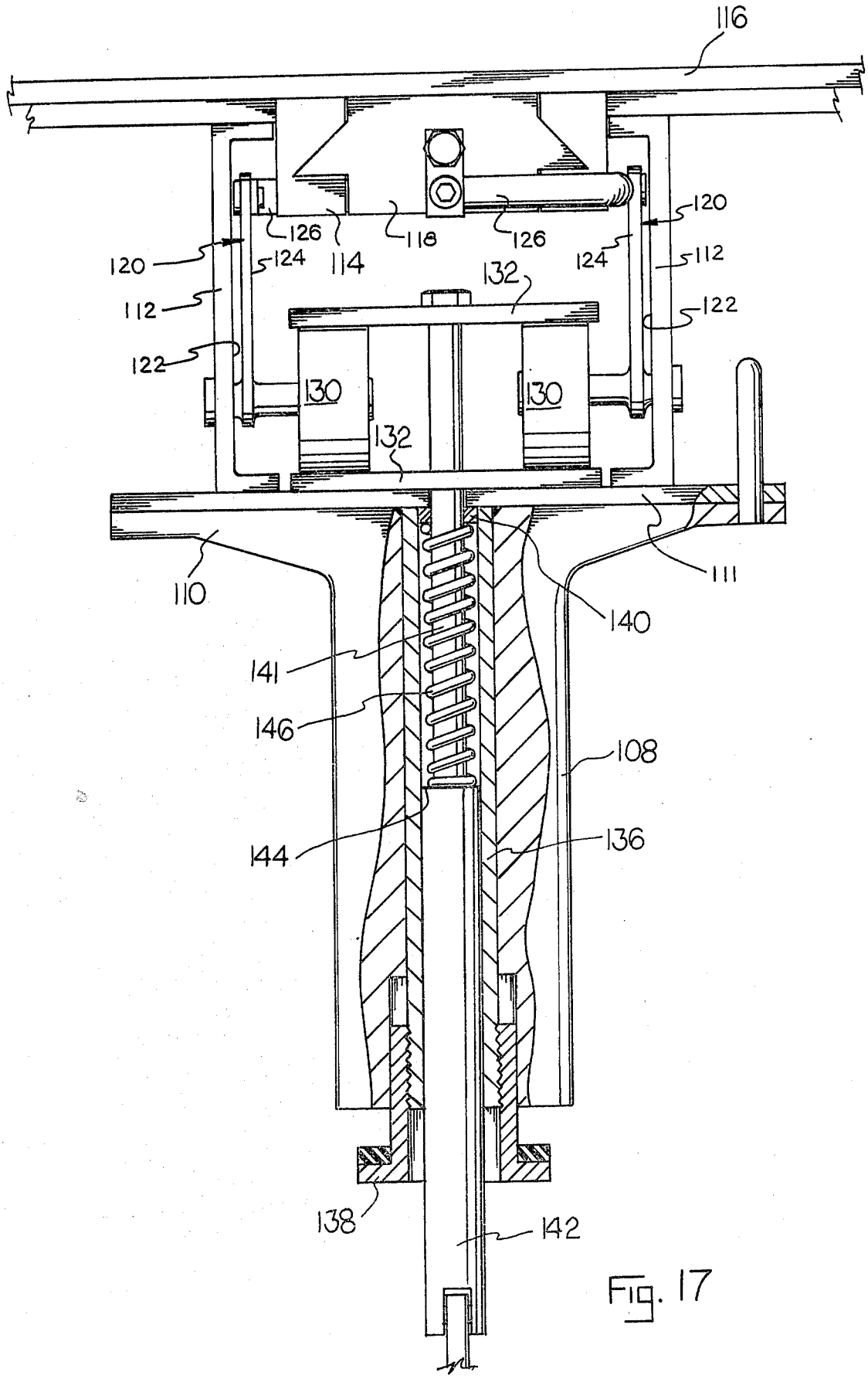
FIG. 17 is an end elevational view of the nipper of this invention.

FIGS. 14–16 illustrate the various stages of operation of nipper 26 as seen from the path of travel of pages 12. Carrier 16 is not shown but it retains its firm grip on pages 12 while it stops momentarily over nipper 26 during the application of cover 14. Nipper 26 is located downstream from glue pot 22 on binding machine 10 so that cover 14 will be adhesively held onto the glued edge of pages 12 when the nipper applies it.

Nipper 26 is composed of an actuating mechanism 104 and a pinching mechanism 106. Actuating mechanism 104 includes a hollow cylindrical housing 108 which terminates at its upper end in a flange 110. Flange 110 is attached to the frame 102 of binder 10 and locates nipper 26 in its proper position. Pinching mechanism 106 includes a base formed of two parallel facing channel members 112. Channels 112 are attached at their lower ends to a plate 111 which rests on actuator housing flange 110. Channels 112 are attached to a slide 114 at their upper end. Two separable, opposed table portions 116 rest on top of slide 114. Each table portion 116 has a depending slide part 118 shaped to fit within the grooves of slide 114 so that the table portions can be shifted together or apart. Each channel 112 pivotally mounts a bell crank 120 on its inner face 122. Bell cranks 120 each have an arm 124 which is connected to one end of a rod 126. The other end of each rod 126 is connected to a table slide portion 118 so that pivotally shifting bellcranks 120 causes table portions 116 to move toward or away from each other depending on which direction the bellcranks are shifted. To accomplish shifting of bellcranks 120 the other arms 128 of the bellcranks are concentrically connected to rollers 130. Rollers 130 are contained between two spaced plates 132, the lower of which rests on pincher base plate 111. Plates 132 are shiftable upwardly from plate 111 thereby causing pivotal movement of bellcranks 120 and corresponding movement of table portions 116 toward each other.

Actuating mechanism 104 shifts the entire pinching mechanism 106 upwardly and causes table portions 116 to slide toward each other in a single cycle of motion, thereby applying cover 14 to the glued edges of pages 12. Actuating mechanism 104 includes cylindrical housing 108. Housing 108 has an enlarged bore portion 134. A hollow shaft 136 fits slidably within the bore of housing 108 and is attached at its upper end to pinching mechanism base plate 111. The other end of shaft 136 is externally threaded and has an outwardly flanged cap 138 threaded thereon which fits within enlarged bore portion 134. The upper end of shaft 136 has an internal shoulder 140. A second shaft 142 slidably fits within shaft 136 and has an end portion 141 with a diminished diameter which fits through an opening in plate 111 and is firmly attached to roller plates 132. Diminished end portion 141 forms a shoulder 144 on shaft 142. A helical spring 146 is compressed between shoulder 144 and hollow shaft internal shoulder 140. Shaft 142 is pivotally connected by a connecting rod 148 to the eccentric drive 150 of an electric motor 152.

In its lower or static position, illustrated in FIG. 14, pinching mechanism 106 rests on actuator housing flange 110 and drive 150 of motor 152 is in a downward position. At this position pages 12 are located a small distance above table portions 116 and are longitudinally aligned with the gap between the separated table portions. When carrier 16 stops over nipper 26, motor 152 is actuated. In the first part (arrow 151) of the revolution of drive 150, illustrated in FIG. 15, pinching mechanism 106 is lifted (arrow 153) by actuator mechanism 104 from its static position so that cover 14, supported upon table portions 116, is placed in contact with the glued edge of pages 12. Spring 146 must be sufficiently stiff to lift the weight of pinching mechanism 106 without deflecting. Shafts 136 and 142 continue their travel together in the direction indicated by arrow 154 until flanged cap 138 makes contact at its flange with the lower end of housing 108 thereby halting the upward motion of shaft 136 and the attached pinching mechanism. Shaft 142 continues its upward motion, as illustrated in FIG. 16, compressing spring 146 to move upward through the opening in plate 111 causing roller plates 132 to lift off of plate 111. As previously explained, upward movement of roller plates 132 causes pivotal movement of bellcranks 120 thereby moving table portions 116 together, as indicated by arrows 156, to firmly pinch cover 14 onto pages 12 and fold it upward to form the cover for the sides of the pages. Upon completion of the revolution of drive 50 to its static position the above movements are in the opposite direction and in reverse order.

Carrier 16 then proceeds to delivery station 28 and releases the covered pages for stacking and returns to its point of origin to receive another set of collated pages for processing and covering.

It is to be understood that the above described invention is not to be limited to the details given but may be amended within the scope of the appended claims.

I claim:

1. In an adhesive binding machine for collated paper, said machine including a glue pot having side walls and a bottom wall across which said paper traverses, roller means within said pot for applying glue from a glue supply contained in said pot to a trimmed edge of said pages, the improvement in said glue pot comprising a second roller means parallel to and rotatable in the same direction as said first mentioned roller means for applying glue from said glue supply to said trimmed paper edge, means for rotating said first mentioned and second roller means in the direction of travel of said paper across said glue pot, string means stretched across said glue pot downstream relative to the direction of travel of said paper from said second roller means for wiping excess glue from said trimmed paper edges.

2. The adhesive binding machine of claim 1 wherein said first mentioned and second roller means are each carried on a shaft which is journalled in said glue pot side walls, corresponding ends of said shafts extending outside of said side walls and each carrying a spur gear thereon, each spur gear being driven by a central main gear connected to a motor drive shaft.

3. The adhesive binding machine of claim 1 wherein said first mentioned and second roller means are each carried on a shaft which is journalled at one end in said glue pot side walls, said glue pot including a first divider means extending between two of said side walls and journalling opposite corresponding ends of said roller shafts, said divider means spaced from said glue pot bottom wall for feeding glue to said first mentioned and second roller means.

4. The adhesive binding machine of claim 3 wherein said glue pot includes a second divider means spaced from said first divider means for retaining unmelted glue between one of said side walls and the second divider means, said second divider means extending to said glue pot bottom wall and being reticulated to permit the melted flow of glue therethrough.

5. The adhesive binding machine of claim 1 wherein said glue pot bottom wall includes an internal raised portion which forms a well for accommodating the lower periphery of said first and second roller means, said raised portion sloping downwardly in said direction of travel of said paper.

6. The adhesive binding machine of claim 1 wherein said glue pot includes damming means raised from said bottom wall between said first and second roller means for restricting the flow of glue between said rollers.

7. the adhesive binding machine of claim 1 wherein the upper periphery of said first mentioned roller means is higher than the upper periphery of said second roller means, said first roller means for forcing glue between the edges of said paper and said second roller means for applying a coat of glue on the edges of said paper.

8. In an adhesive binding machine for collated paper, said machine including a frame carrying a device for applying a cover sheet to said paper about one trimmed edge having glue applied thereon, said cover applicating device including nipper means having slidable opposed table portions for supporting said cover and pressing the cover about said trimmed edge, said table portions having corresponding lower and upper positions and first and second spaced positions wherein the table portions are more closely positioned to each other when in said second position, the improvement comprising actuator means including a cyclical motor means for actuating the actuator, said actuator means for shifting said table portions from said lower position into said upper position when supporting said cover to urge the cover into contact with said trimmed edge and shifting said table portions from said first position into said second position during one cycle of said motor means, said nipper means including camming means connected between said actuator means and said table portions for shifting said table portions from said first position to said second position, said camming means including a pair of bellcranks, one arm of each bellcrank connected to a table portion and the other arm of each bellcrank eccentrically connected to a roller cam wherein upper movement of the roller cam causes the connected table portion to shift into said second position, upper and lower rigidly spaced cam retainer plates, each roller cam being located between and horizontally shiftable between said retainer plates, said actuator means including a housing connected at its upper end to said machine frame and having a bore therethrough, a hollow cylindrical shaft fitting slidably within said housing bore and having an upper end and a lower end, a vertically shiftable support carrying said table portions and camming means, said hollow shaft upper end being connected to said support, said hollow shaft lower end carrying a stop engageable with the lower end of said housing, a second shaft fitting slidably within said hollow shaft and pivotally connected at its lower end to a motor means eccentric crank, said second shaft having an upper end attached to said lower cam retainer plate, biasing means between said second shaft and hollow shaft for causing the joint upper movement of the second shaft and hollow shaft relative to said housing to cause said support to shift upwardly and said table portions to shift into said upper position, said biasing means yielding to permit upper movement of the second shaft relative to the hollow shaft when said stop contacts the lower end of said housing to cause said cam retainer plates to shift upwardly and said table portions to shift into said second position.

* * * * *